US006494237B1

(12) United States Patent
Piegeler

(10) Patent No.: US 6,494,237 B1
(45) Date of Patent: Dec. 17, 2002

(54) SHED FORMING DEVICE FOR THE TEXTILE INDUSTRY

(75) Inventor: Uwe Piegeler, Düsseldorf (DE)

(73) Assignee: Gerhard Piegeler, Hann (DE)

( * ) Notice: Subject to any disclaimer, the term of this patent is extended or adjusted under 35 U.S.C. 154(b) by 0 days.

(21) Appl. No.: 09/979,487

(22) PCT Filed: May 20, 2000

(86) PCT No.: PCT/DE00/00854

§ 371 (c)(1),
(2), (4) Date: Nov. 16, 2001

(87) PCT Pub. No.: WO00/70135

PCT Pub. Date: Nov. 23, 2000

(30) Foreign Application Priority Data

May 16, 1999 (DE) ..... 199 22 083
Jul. 26, 1999 (DE) ..... 199 34 447

(51) Int. Cl.[7] ..... D03C 3/24
(52) U.S. Cl. ..... 139/455; 139/55.1; 139/59
(58) Field of Search ..... 139/455, 59, 55.1, 139/11, 435.1

(56) References Cited

U.S. PATENT DOCUMENTS 2,204,891 A 6/1940 Hamilton
3,186,439 A 6/1965 Seiler
5,363,884 A * 11/1994 Migliorini et al. ..... 139/455
5,676,179 A * 10/1997 Morandi ..... 139/455
5,806,348 A * 9/1998 Cheng ..... 139/455
6,116,293 A * 9/2000 Stimpl ..... 139/455

FOREIGN PATENT DOCUMENTS

| | | |
|---|---|---|
| DE | 3614395 | 10/1987 |
| EP | 0556165 | 8/1993 |
| NL | 1007604 | * 11/1997 |
| WO | 9506767 | 3/1995 |

* cited by examiner

*Primary Examiner*—John J. Calvert
*Assistant Examiner*—Robert H. Muromoto, Jr.
(74) *Attorney, Agent, or Firm*—Patzik, Frank & Samotny Ltd.

(57) ABSTRACT

The invention relates to a shed forming device without a harness for the textile industry, preferably a weaving device which contains a number of healds (4) with thread eyelets (5) for guiding the warp threads. The healds (4) are guided through boreholes (31, 31') of guide elements (20, 6). Said healds (4) are positioned in such a way, that at least one of the guide elements (6) is configured as a lifting element of a lift generating device, in order to perform a vertical ascending and descending movement. An optional connection between the guide element (6) and the heald (4) can be made and electrically controlled by catch devices in the horeholes (31, 31'), in such a way, that the heald can be caught by the lifting movement. A shed of warp threads can thus be formed which conforms to a pattern.

13 Claims, 9 Drawing Sheets

(State of the art)

SHED FORMING DEVICE FOR THE TEXTILE INDUSTRY

TECHNICAL FIELD

The invention concerns a shed forming device for the textile industry, comprising movable positioning elements having thread eyes for receiving threads of a material web to be produced, at least one guide element for guiding the positioning elements, a lift generating device and selectively actuable arresting devices for connecting or releasing the positioning elements to or from the lift generating device in such a way that the threads of the material web to be produced can be moved into positions which are in accordance with a pattern and a weave.

STATE OF THE ART

When weaving textiles threads extending in parallel (warp threads) in a weaving machine are moved in accordance with a desired pattern into an upper shed and a lower shed position respectively in order in that way to form the so-called weaving shed through which the weft thread can be guided transversely to the direction of the above-specified warp threads. After the weft thread is passed from one side of the material web to the other, the next weaving shed is produced with a different distribution of the warp threads in the upper shed and lower shed respectively, in accordance with the pattern to be woven, and the next weft thread is passed through the new weaving shed. In the simplest case one warp thread is introduced alternately into the upper shed and one warp thread into the lower shed (linen or basket weave).

The Jacquard weaving procedure is also known for the production of more complicated weaving patterns, in which the movement of the individual warp threads (hereinafter: individual threads) can be controlled in accordance with a certain program. Each individual thread for that purpose is passed through a yarn eye on a positioning element, the so-called heald, wherein the positioning element is fixed at one end to a resilient spring and at the other end to a lift element. A movement of the lift element causes a pulling force to be applied to the positioning element which thereby moves perpendicularly to the plane of the material web to be woven, causing the string to be stretched, and in so doing entrains the individual thread which passes through the thread eye. The individual threads are thus passed into the so-called upper shed. Individual threads which are passed through the yarn eye of a positioning element and to which no pulling force is applied by a lift element in contrast remain in the lower shed position. The term Jacquard machine in the narrower sense is used to designate the lift generating device in which the positioning elements can be connected to or released from a moving lift element of the lift generating device selectively, that is to say in accordance with the weaving step to be implemented in order to produce a given pattern. A Jacquard machine of that kind is generally disposed centrally and at some height above the loom as the positioning elements extending from the Jacquard machine (harness twines with healds and counter-pull springs) must be distributed over the width of the material web and in that case the hardness twines are not to involve excessively sharp angles so that excessively severe bending does not occur. The distribution of the positioning elements over the width of the material web is achieved by way of guide and arranging elements (the so-called web harness). A disadvantage with the known Jacquard weaving procedure is that, because of the described structure, it requires a considerable amount of space in terms of height and that the structural elements such as in particular the guide elements and the springs, at the high weaving speeds that the arrangement aims to achieve, are exposed to an enormous loading which results in rapid wear of those elements.

U.S. Pat. No. 3,186,439 discloses a loom in which, by means of a weaving harness-like arresting device which for the major part is mounted in front of the movable lift elements, the healds can be connected to and released from those lift elements which are movable up and down. For the purposes of reading or picking out the respective next shed position the healds, governed by the structure involved, are necessarily always moved into the middle shed after each pick. This arrangement, by virtue of the structure involved, does not afford a stationary guide and arresting device.

STATEMENT OF THE INVENTION

The object of the present invention was to provide a shed forming device for the textile industry, which is structurally simpler and more compact and which operates reliably and with a low rate of wear even at high cycle speeds.

That object is attained by a shed forming device for the textile industry, which includes movable positioning elements having thread eyes for receiving threads (warp threads) of a material web to be produced, at least one guide element for guiding the positioning elements, a lift generating device which can operate in a predetermined cycle sequence, and selectively actuable arresting devices for connecting or releasing the positioning elements to or from the lift generating device in such a way that the threads of the material web to be produced can be moved into positions which are in accordance with a pattern and a weave. The shed forming device is characterised in that at least one of the guide elements is in the form of a lift element of the lift generating device and is provided with arresting devices. The positioning elements can also be provided with arresting devices.

By virtue of a guide element being in the form of a lift element it becomes at the same time an arranging element which contributes to arranging the individual threads in a given shed. For the sake of simplicity hereinafter however reference will still only be made to guide elements. The guide elements provide for distribution and guidance of the positioning elements over the width of the material web to be produced. The consequence of at least one of those guide elements being in the form of a lift element and being provided with arresting devices is that at least a part of the positioning elements is entrained by the guide element and therefore the transmission of the lift movement is distributed over the width of the material web. Unlike the situation in the state of the art therefore the corresponding positioning elements do not need to be provided with so-called harness twines and they in turn do not need to be deflected at a comparatively sharp angle at the guide elements to a centrally arranged Jacquard machine. That has on the one hand the advantage that there are no direction-changing locations with corresponding frictional losses and wear. On the other hand the positioning elements can be of a different nature in terms of their properties. In particular they do not have to be so flexible that they permit a change in direction of that kind. That permits a greater degree of freedom in terms of the design configuration and choice of material for the positioning elements, in which respect in particular it is possible for them to be rigid to flexurally elastic, so that it is possible to omit a counter-pull spring at the opposite end of the positioning element. In that way it is possible to save on a further component which suffers from severe wear.

Preferably there are provided a plurality of guide elements which are arranged parallel and at a spacing relative to each other and which at the same time are in the form of a lift element of the lift generating device. By virtue of having a plurality of guide elements in the form of a lift element, it is possible to form more complicated sheds. Thus for example the individual threads can be set to a lower shed, a middle shed, and an upper shed, whereby it is also possible to provide for use thereof for double-plush weaving machines (three-position weaving machines).

Optionally, there is preferably provided beside the guide element or elements in the form of a lift element, at least one further guide element which can be of a stationary nature. Stationary guide elements of that kind enhance the stability and precision of the movement of the positioning elements and thus contribute to making it possible to achieve high weaving speeds in a reliable fashion and with a smooth mode of operation.

In this respect, in accordance with a development of the invention, arresting devices can be provided on the stationary guide elements, for connecting or releasing the positioning elements to or from the guide element. By virtue of those arresting devices, it is thus possible to stationarily fix the positioning elements so that they cannot participate in any movement of the lift element. The arresting devices therefore supplement corresponding arresting devices on the movable guide elements. In that respect, for a given positioning element, in a given cycle of the weaving machine, there is only ever one of the arresting devices—either that on the movable guide element or that on the stationary guide element—that is in the fixed condition (connection to the corresponding guide element), while the other arresting device is released. The arresting devices on the stationary guide elements cause the positioning elements to remain in the respective position when that is wanted by virtue of the patterning effect.

In accordance with. a development of the invention the guide elements have a plurality of openings which are arranged at spacings and through which the positioning elements are passed. The distribution of the positioning elements over the material web to be produced can be controlled in a simple manner, by means of the pattern of the openings.

Both the front regions, the front end regions and the end regions of the positioning elements can be such that they can be connected to or released from the guide element or elements.

In a preferred embodiment of the invention the positioning elements having the thread eyes are in the form of rigid, preferably flexurally elastic and/or preferably one-piece bodies. A rigid or fixed design configuration affords the advantage that a high degree of stability of the positioning element can be achieved in that way. That is advantageous in particular for the reason that the positioning element is exposed to a considerable loading by virtue of the high cycle sequences in weaving machines. As the present invention provides that the positioning element does not have to be of any configurations involving a change in direction, it does not have to be flexible like a twine, as in the state of the art. The positioning elements can therefore be both less expensive and also at the same time more stable and can thus be produced more reliably. In addition the flexural elasticity involved provides that the positioning element follows the movements of the lift element to which it is connected, in both directions. As a result it is possible in particular to omit a counter-pull spring at the other end of the positioning element. That not only saves on manufacturing costs but also considerably reduces the susceptibility to wear of the apparatus.

The arresting devices which are used in the shed forming device according to the invention are preferably electronically actuable in order to produce or release arresting of the positioning elements. The electronic actuatability thereof ensures that virtually any desired weaving pattern can be produced by suitable programming, in which respect a change in the pattern merely requires suitable re-programming or replacement of the software.

In addition it can be provided in accordance with the invention that the arresting devices on the guide elements and/or the stationary guide arresting elements, in the region of the openings, have recesses for the selective engagement or non-engagement of noses which are provided on the positioning elements, and that selectively actuable devices are provided for moving the positioning elements transversely with respect to the lift direction into the engagement position or the non-engagement position, and that the width of opening of the openings is such that unimpeded lift movement is possible in the non-engagement position. Alternatively it can also be provided that the positioning elements have recesses and corresponding noses are provided in the region of the openings. In that way positioning elements can be easily arrested or released respectively. The device for moving the positioning elements transversely with respect to the lift direction can be arranged stationarily—in relation to the lift movement—and the positioning elements have completely or partially surrounding transverse displacement elements which can be actuated in a suitable manner.

BRIEF DESCRIPTION OF THE DRAWINGS

The invention is described by way of example hereinafter with reference to the drawings in which.

DETAILED DESCRIPTION OF THE DRAWINGS

Figure 1:
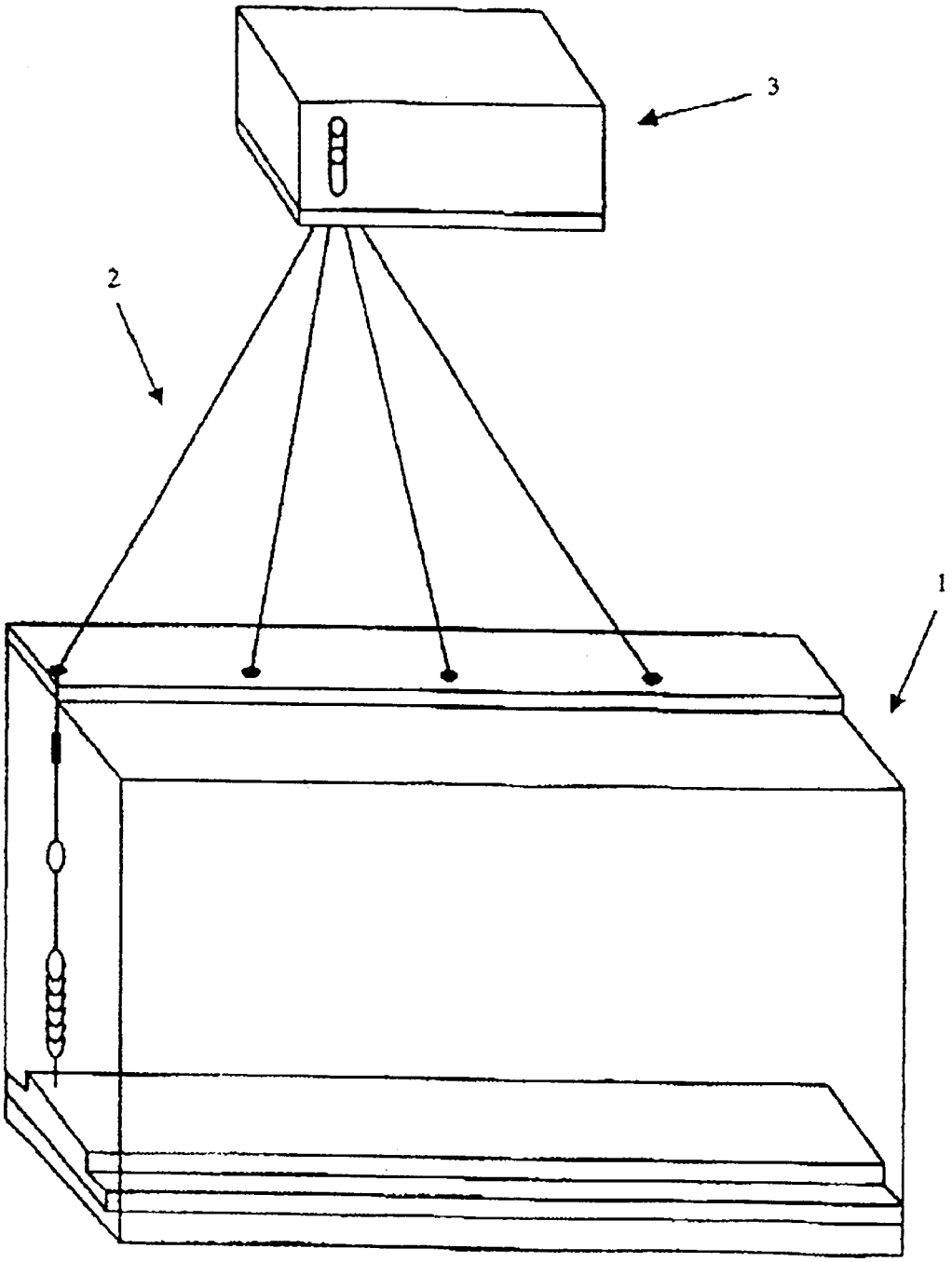
FIG. 1 is a perspective view showing the essential elements of a Jacquard weaving apparatus in accordance with the state of the art.

FIG. 1 shows a perspective view of a weaving machine known from the state of the art, using the Jacquard weaving procedure. The actual weaving machine is identified by 1, the so-called weaving harness by 2 and the Jacquard machine by 3. Such an arrangement implements individual thread control in accordance with a pattern, for each repeat, by means of a Jacquard machine 3 and a harness 2 which forms the connection from the Jacquard machine to the weaving machine 1.

As the Jacquard machine 3 must be placed at a considerable height above the weaving machine 1, a suitable superstructure which carries the Jacquard machine 3 and accordingly also a corresponding spatial height for the production building is required. Because of the continuously increasing number of revolutions the harness is exposed to an extremely high loading, so that frequently it has only a very short service life.

The high frictional values of the respective components involved in frictional relationship with each other such as the comber board and the harness twines, the generation of heat which occurs as a result and in particular the problems of the counter-pull members in the form of coil springs in respect of their dynamic performance make the harness a weak point in Jacquard weaving. In the triple combination of weaving machine 1, Jacquard machine 3 and weaving harness 2, the weaving harness is the clearly weakest link in the chain and in part impedes both technical options and also economical production.

The present invention resolves all the above-mentioned problems in that the harness is eliminated and, in place of the Jacquard machine which was hitherto required, it is possible to use a shed forming device which, by means of movable and possibly also stationary guide elements, controls the positioning elements provided in accordance with the invention (special healds) into which the warp threads are fitted, into the desired upper shed and lower shed positions, in accordance with the pattern. As this shed forming device can be positioned at a low height above or above and/or below the shed, the expensive superstructures become redundant. As a result Jacquard weaving can be carried out in production buildings of low height. Details and the operating principle of the shed forming device according to the invention are described hereinafter with reference to the embodiments shown in FIGS. 2 through 7.

Figure 2:
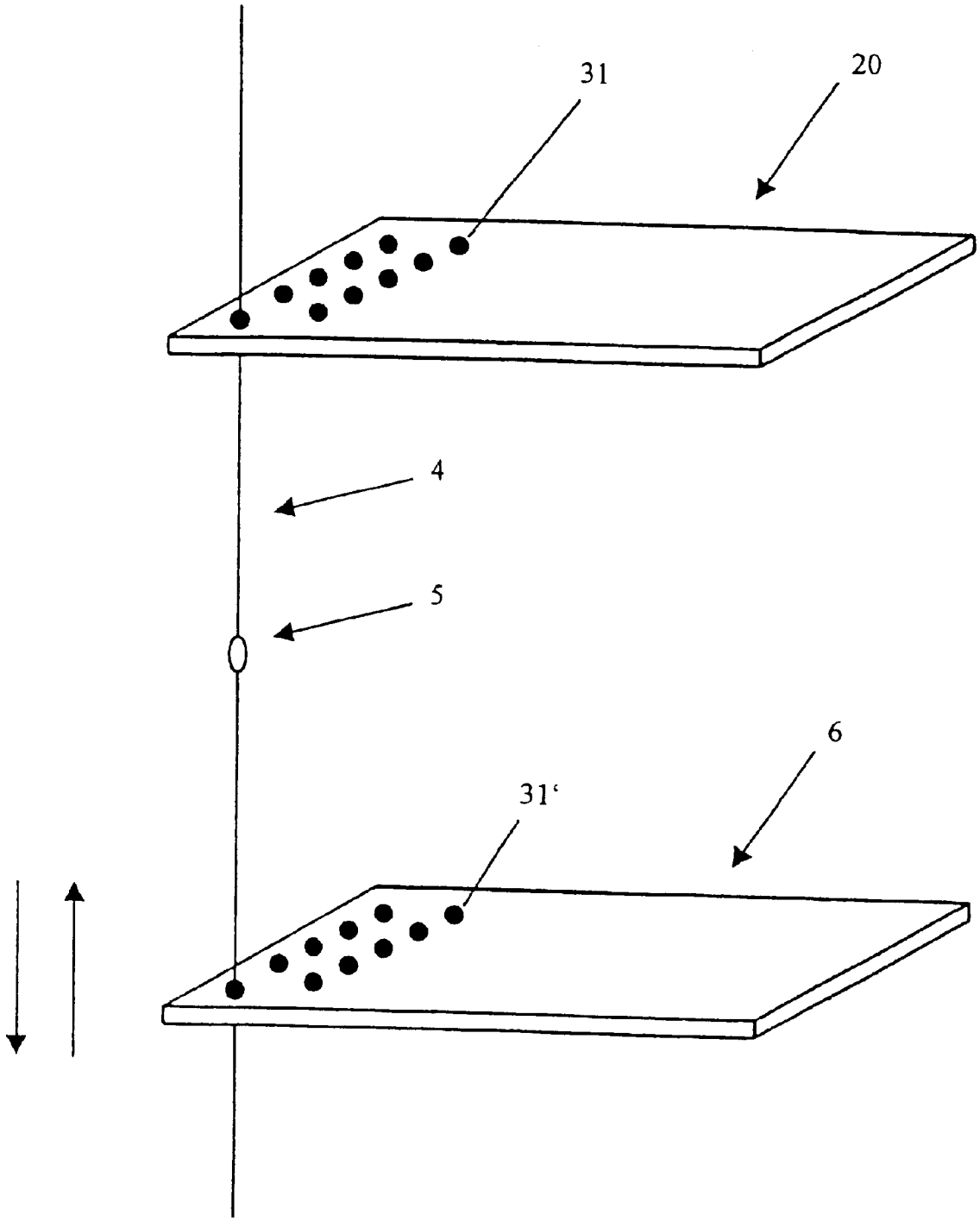
FIG. 2 is a perspective view showing a positioning element and two guide elements from a shed forming device according to the invention.

FIG. 2 show a perspective view showing three essential elements of the shed forming device according to the invention. Shown therein is a positioning element 4 which is referred to hereinafter as the heald, with a thread eye 5. A warp thread of the material web to be produced is passed through the thread eye 5 so that it can be selectively positioned in a vertical direction by upward and downward movement of the heald 4.

Above the thread eye 5 the heald 4 is passed through a bore 31 in a stationary guide element 20 and below the thread eye it is passed through a bore 31' in a movable guide element 6. The guide elements 20 and 6 include a plurality of bores which are arranged in a grid configuration, only a part thereof being shown. A heald whose thread eye can cause a given warp thread to be positioned in accordance with the required pattern can pass through each of those bores 31, 31'.

While the upper guide element 20 is stationarily connected to the weaving apparatus, the lower guide element 6 serves at the same time as a lift element of a lift generating device. That means that it can perform an upward and downward movement in a lift range which is indicated by a double-headed arrow. In that respect, provided in the bores 31' are arresting devices (not shown), by the actuation of which a fixed coupling between the heald 4 and the guide element 6 can be made or such a coupling can be released.

If coupling in relation to the heald 4 is produced by suitable actuation of the arresting device in the bore 31', the heald is entrained by the lift movement of the movable guide element 6. Actuation is effected preferably electronically and/or pneumatically and/or mechanically, with the guide element 6 and/or the heald 4 being suitably designed for that purpose. In the specified manner, the thread eye 5 can be positioned in a desired position, for example the upper shed or the lower shed.

Additionally or alternatively a heald which in the current operating cycle is not taking part in the movement of the guide element 6 can also be connected by a suitable arresting device in the bore 31 of the stationary guide element 20 to that guide element. That ensures that the heald remains stationary. It will be appreciated that for that purpose the heald must be simultaneously uncoupled from the guide element 6.

The device according to the invention is limited in respect of its structural height to a region which is substantially less than the structural height of a Jacquard loom with weaving harness and Jacquard machine. In particular the disadvantages of a weaving harness such as harness twine breakages as a result of extreme angles and extremely high frictional values of the harness twines in the direction-changing elements are eliminated. A further advantage is the elimination, achieved thereby, of fractures of the counter-pull springs as a consequence of dynamic and/or static loadings on those springs.

Figure 3:
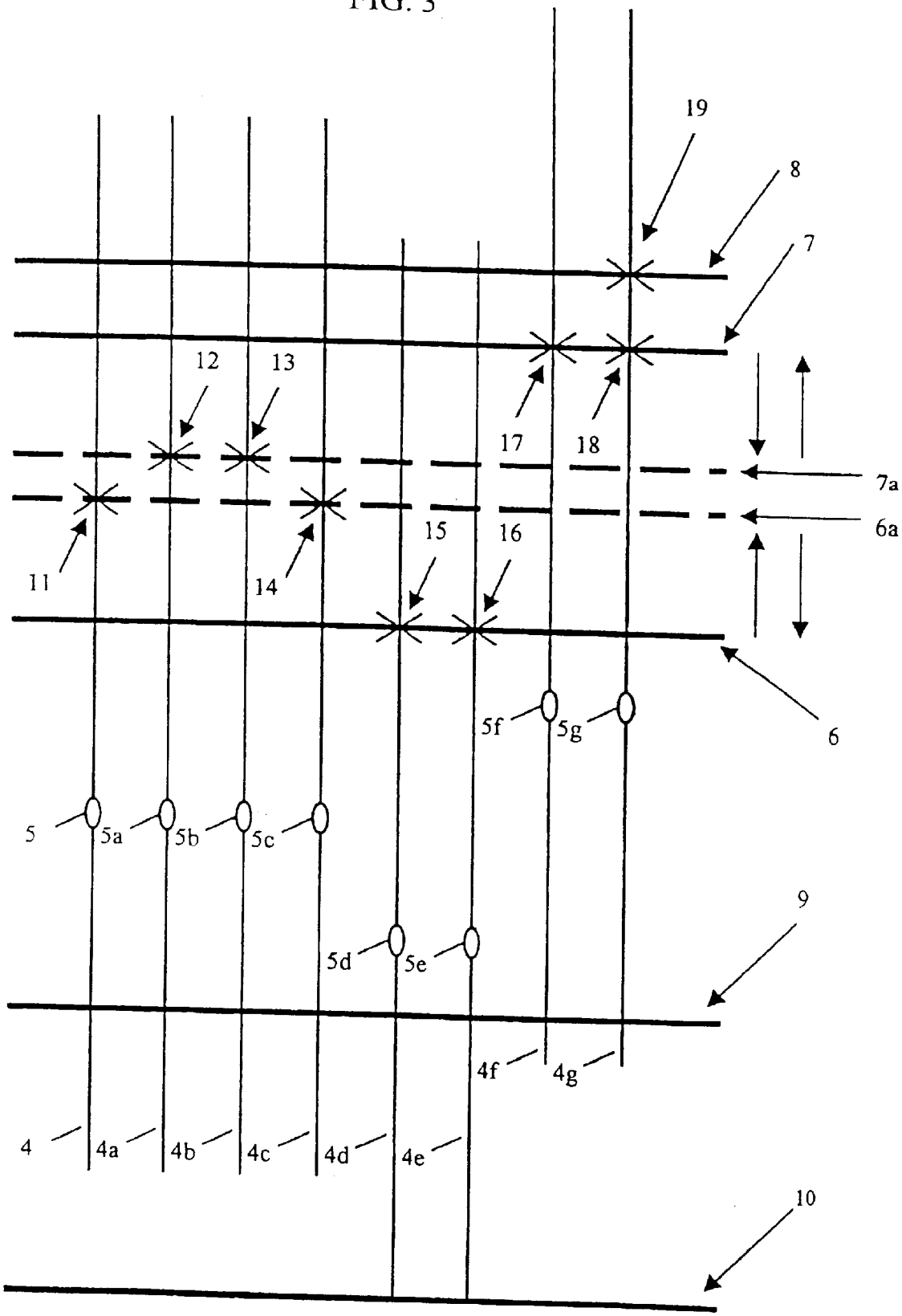
FIG. 3 is a diagrammatic view showing the arrangement of positioning elements, two movable guide elements, a stationary arresting element, a stationary guide element and a floor for setting up the positioning elements.

FIG. 3 shows the operating principle of the shed forming device with two movable guide elements which at the same time are lift elements (referred to hereinafter as guide lift elements). The guide lift element for the lift range low-middle and middle-low is identified by 6, the guide lift element for the lift range high-middle and middle-high is denoted by 7, the stationary guide element (hereinafter referred to as the guide arresting element) for arresting the healds in the lower and upper shed respectively is denoted by 8, the stationary guide element for receiving the healds beneath the shed is denoted by 9 and the safety floor which can prevent the healds from slipping out is denoted by 10. The lift region of the guide lift elements 6 and 7 is illustrated in each case by means of the solid lines and the broken lines 6*a* and 7*a* and the parallel oppositely directed arrows.

The healds with the thread eyes 5, 5*a*, 5*b*, 5*c*, 5*d*, 5*e*, 5*f* and 5*g* are denoted by 4, 4*a*, 4*b*, 4*c*, 4*d*, 4*e*, 4*f*, 4*g*. By virtue of their fixing 11 and 14 respectively to the guide lift element 6 the healds 4 and 4*c* are then in the middle shed when the guide element 6 assumes the position indicated at 6*a*. By virtue of their fixing 12 and 13 to the guide lift element 7 the healds 4*a* and 4*b* are also then in the middle shed when the guide lift element 7 assumes the position indicated at 7*a*. By virtue of their fixing 15 and 16 to the guide lift element 6 the healds 4*d* and 4*e* are in the lower shed. By virtue of their fixing 17 and 18 to the guide lift element 7 the healds 4f and 4*g* are in the upper shed.

By virtue of their fixing 19 to the stationary guide element 8 the heald 4*g* also remains in the upper shed in the next pick. For that purpose the fixing 18 to the guide lift element 7 is released before the downward movement of the guide lift element 7 begins.

The fixing or binding locations, indicated at 11, 12, 13, 14, 15, 16, 17, 18 and 19, of the healds to or in the bores 31, 31' of the guide lift elements 6 and 7 and of the stationary guide arresting element 8 for arresting the healds in the lower shed and in the upper shed respectively can be effected by means of magnets, a magnetic circuit, by means of electrical fields, by pneumatic means, but also by means of mechanical anchoring and positively locking engagement and the like. For that purpose it is desirable for both the bores 31 and 31' in the guide elements and also the healds to be of a suitably appropriate design configuration. Each bore or each bore region in the guide lift elements and the stationary guide arresting elements has to be actuated in accordance with the pattern involved. That can be effected by way of special data paths. However wireless actuation is also a possibility. For receiving and guiding the healds the guide elements, instead of bores, can have cavities of any form and nature (for example individual tubes) and in any material implementation.

It is also possible to omit the stationary guide arresting element 8 for arresting purposes above the shed. The arresting action can then be implemented by way of the guide element 9 if that guide element is in the form of an actuable element.

The lift movements of the guide lift elements are achieved by a suitable drive.

In order to produce an inclined shed which may possibly be required, the guide lift elements can be divided into suitable sections so that different lift lengths are made possible.

The dimensions of the guide elements are established in accordance with the respective loading involved, having regard to the weaving width and the number of revolutions of the weaving machine.

The stationary guide arresting element 8 serves for positional fixing of healds in the lower shed and upper shed respectively if they are to remain in the following pick in accordance with the appropriate weave in the previous position. That serves for smoother implementation of the weaving procedure.

In the case of the operational principle shown in FIG. 3 the so-called reading or also neutral position is in the middle shed and at the same time the closed shed. It is in that position that beating-up occurs, by which the weft thread is applied to the previously woven material web. When operating without the additional element 8 the return of all warp threads is effected in the time frame of the beating-up operation, which makes it possible to provide for uniform tensioning of all warp threads during the beating-up operation. That is an aspect of particular advantage for delicate warp materials. As the machine operating on the principle of FIG. 3 permits both modes of operation it is possible to choose accordingly.

Figure 4:
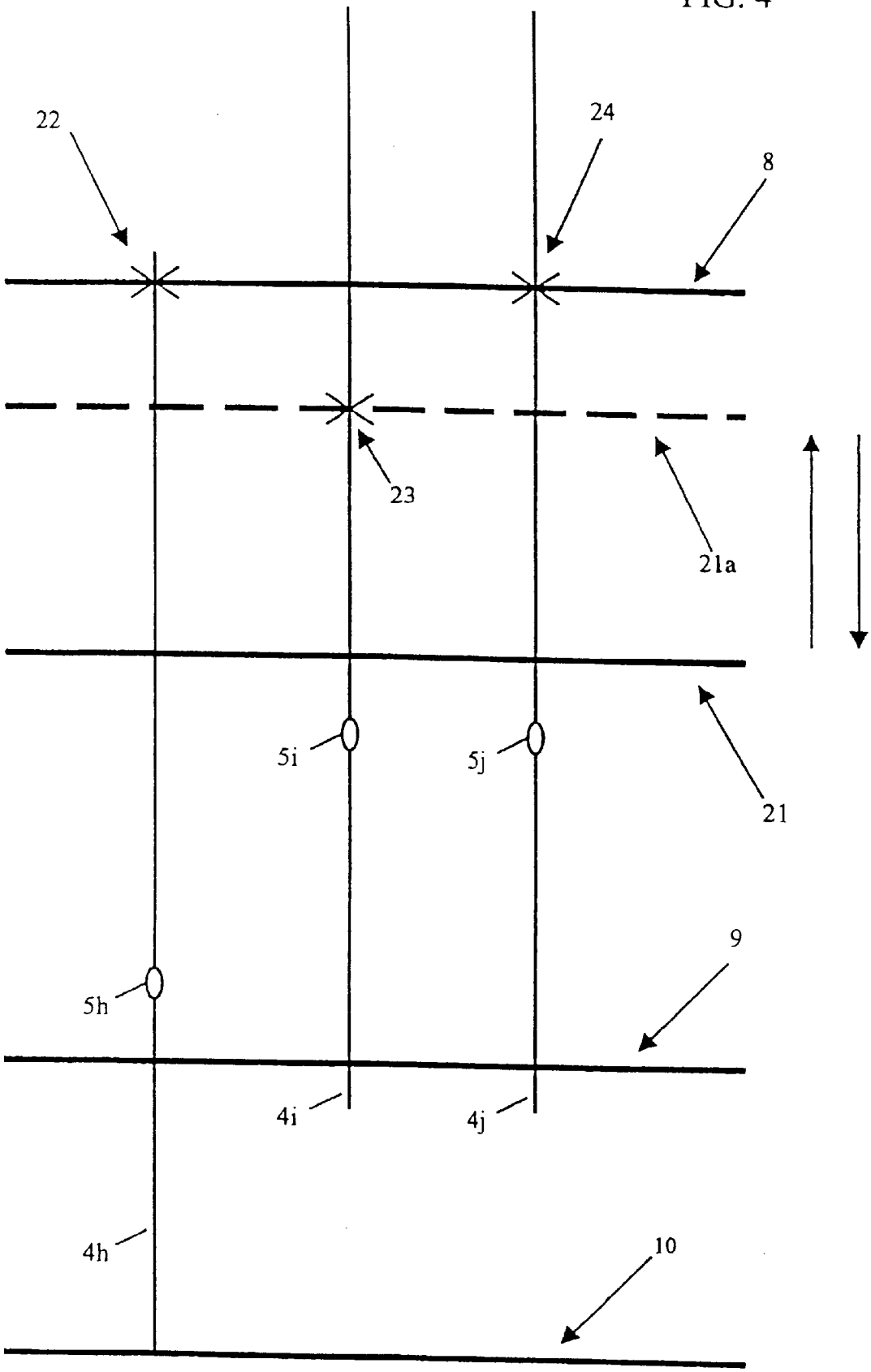
FIG. 4 is a diagrammatic view showing the arrangement of positioning elements, a movable guide element, a stationary arresting element, a stationary guide element and a floor.

FIG. 4 shows the operating principle of the shed forming device with only one guide lift element 21, wherein the reading position can be both in the lower shed (solid line) and also in the upper shed (broken line). In this example the guide lift element 21 performs an upward and downward movement for each pick or each crankshaft revolution of the weaving machine.

In this mode of operation, the stationary guide arresting element, in the reading position in the lower shed, is to perform the function of fixing the healds which are not fixed according to choice to the guide lift element 21 in the upward movement of the guide lift element 21 and thus to hold same securely in the lower shed.

A stationary guide element is identified by 9 and a floor by 10.

The same similarly applies if the reading position is in the upper shed. In this case the function of the stationary guide element 8 is to hold the healds in the downward movement of the guide lift element 21 in accordance with choice in the upper shed. In addition the stationary guide arresting element 8 can also be used as an arresting means for the healds which in accordance with choice are also to remain in the same shed position in the next pick.

The lift range of the guide lift element 21 is illustrated by means of the solid line and the broken line 21*a*.

By virtue of its fixing 22 to the stationary guide arresting element 8 the heald 4*h* is in the lower shed. By virtue of its fixing 23 to the guide lift element 21 the heald 4*i* is in the upper shed. By virtue of its fixing 24 to the stationary guide arresting element 8 the heald 4*j* is in the upper shed.

Figure 5:
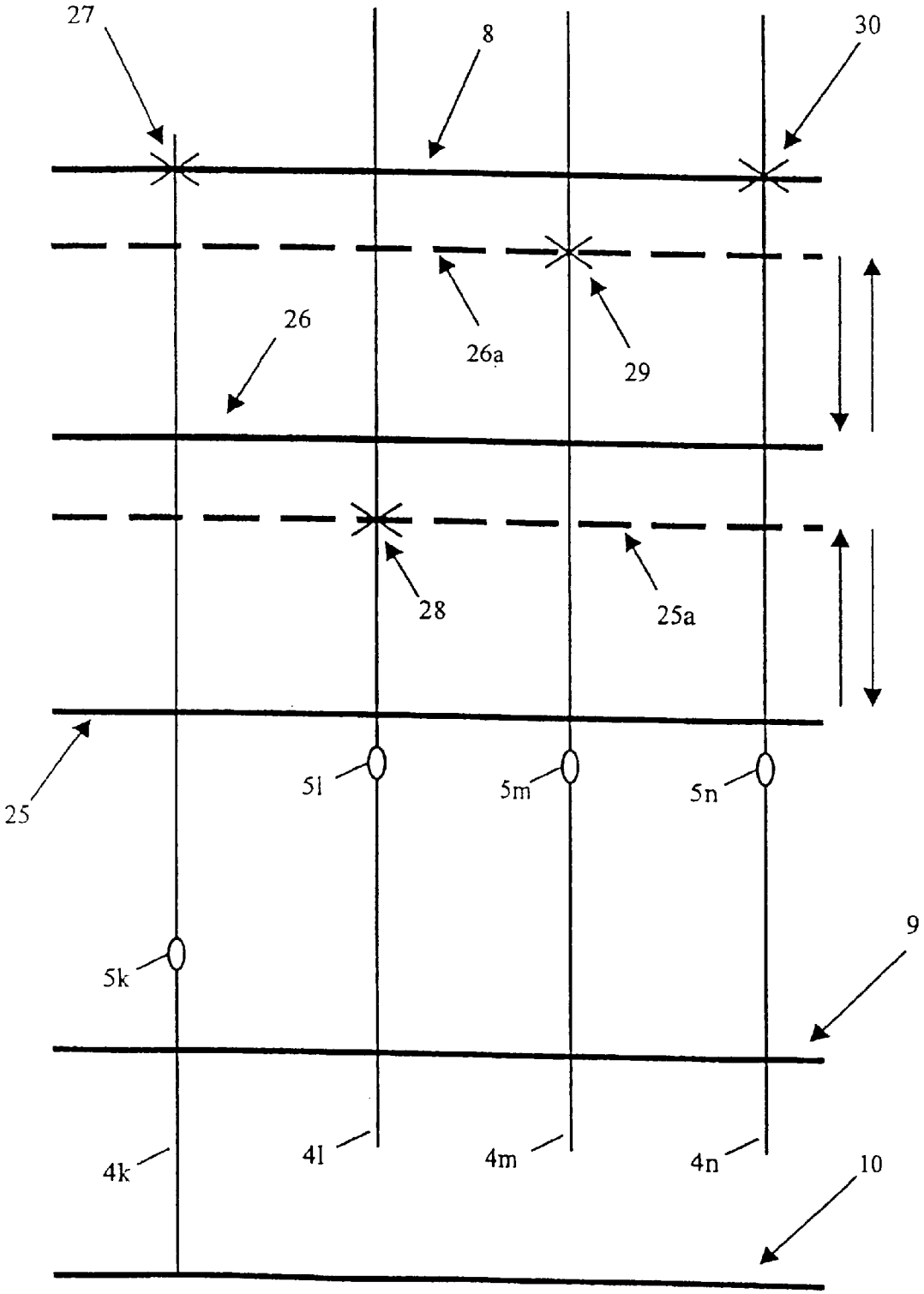
FIG. 5 is a diagrammatic view showing the arrangement of positioning elements, two movable guide elements, a stationary arresting element, a stationary guide element and a floor.

FIG. 5 shows the operating principle of the shed forming device with two guide lift elements 25 and 26. The reading position is alternately in the upper shed and the lower shed for both guide lift elements.

The function of the stationary guide arresting element 8 is to hold the healds in the upper shed and the lower shed respectively according to choice.

The lift range of the guide elements 25 and 26 is respectively illustrated by means of the solid lines and the broken lines 25*a* and 26*a*. By virtue of its fixing 27 to the stationary guide arresting element 8 the heald 4*k* is in the lower shed. By virtue of its fixing 28 the heald 41 is in the upper shed when the guide element 25 assumes the position indicated by 25*a*. By virtue of its fixing 29 to the guide lift element 26*a* the heald 4*m* is in the upper shed when the guide lift element assumes the position indicated at 26*a*. By virtue of its fixing 30 to the stationary guide arresting element 8 the heald 4n is in the upper shed.

Figure 6:
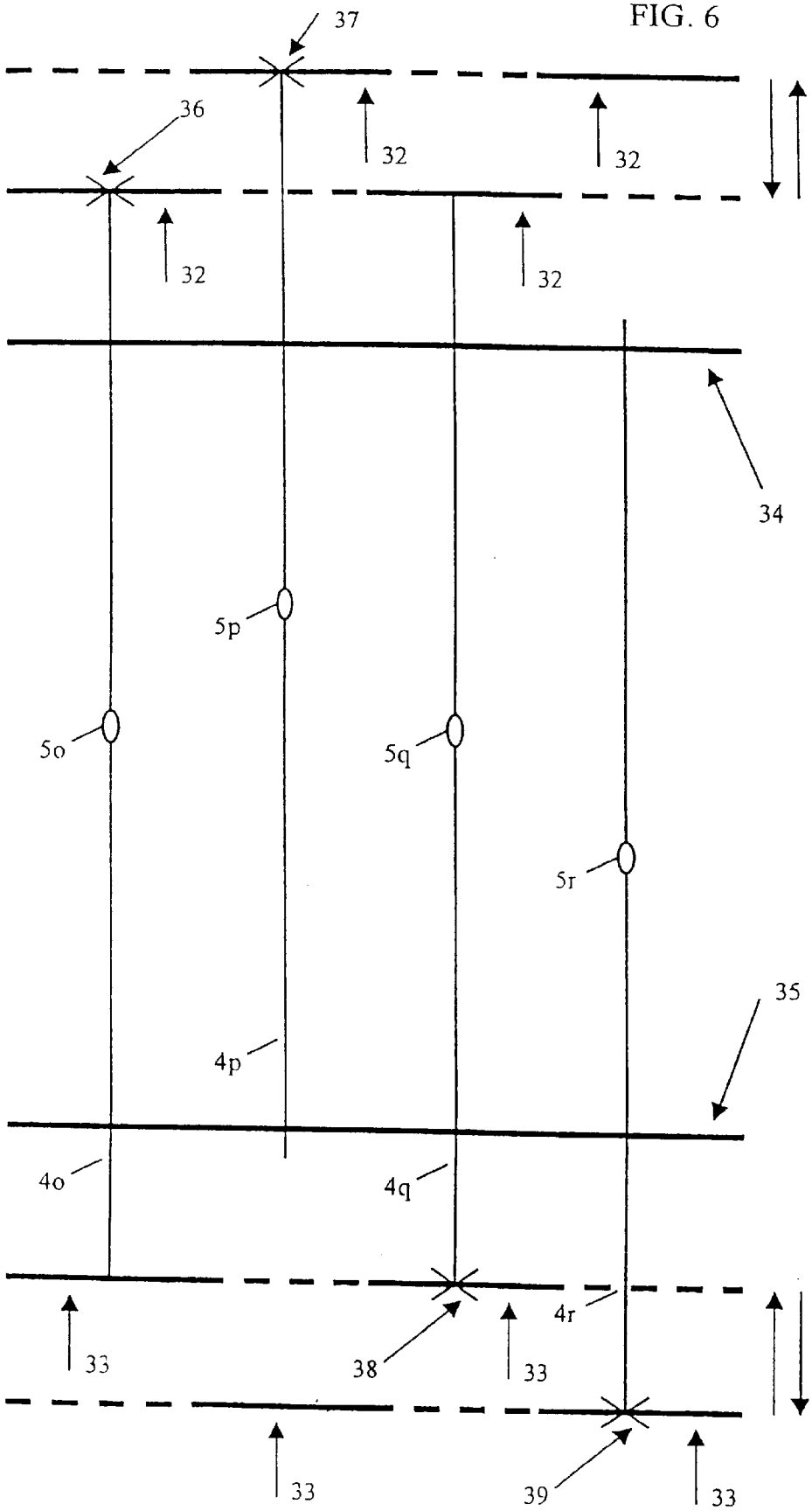
FIG. 6 is a diagrammatic view showing an arrangement of positioning elements and a respective movable guide element arranged above and below the weaving shed, and two stationary guide elements.

FIG. 6 shows the operating principle of the shed forming device with two lift elements 32, 33 and two stationary guide elements 34, 35. The reading position is in the middle shed for both lift elements. The function of the stationary guide elements 34 and 35 is to permanently guide the healds 4*o*–4*r*. The thread eyes of the healds are indicated by 5*o*–5*r*.

The lift elements 32, 33 provide for additional guidance of the healds 4*o*–4*r* only when they are fixed to the corresponding lift elements 32, 33. Fixing of the healds to the lift elements or release thereof is effected at the two end regions of the healds.

In this example the lift elements can be of a similar design configuration to the so-called blades of a Jacquard machine. Equally the healds can be similar to the bars of a Jacquard machine.

The lift range of the lift elements 32, 33 is illustrated by means of the solid and broken lines.

The healds 40 are in the middle shed by virtue of the middle shed and reading position of the lift elements 32, 33. With this mode of operation, basically all healds are in the middle shed, in the middle shed and reading position of the lift elements.

By virtue of the fixing 36 of the healds 40 to the lift element 32 that heald is moved upwardly into the upper shed position. That position is illustrated by means of the heald 4*p*. By virtue of the fixing 37 to the lift element 32 that heald is in the upper shed.

Similarly to that mode of operation for positioning the healds in the upper shed the illustration of the healds 4*q* and 4*r* shows the positioning of the healds in the lower shed. By virtue of the middle shed and reading position of the lift elements 32, 33 the heald 4*q* is in the middle shed. By virtue of the fixing 38 of the heald 4*q* to the lift element 33 that heald is moved downwardly into the lower shed position.

That position is illustrated by means of the heald 4*r*. By virtue of the fixing 39 to the lift element 33 that heald 4*r* is in the lower shed.

The operating examples of FIGS. 3, 4, 5 and 6 show just a few fixing and release combinations of the healds in relation to the lift elements and in relation to the arresting elements (fixing=coupling of the healds to the respective elements; release=uncoupling of the healds from the respective elements). All operating principles afford the possible option of positioning all elements selectively above and/or below the shed. It will be appreciated that there are further possible combinations of the elements required, including in relation to the number of elements.

Figure 7:
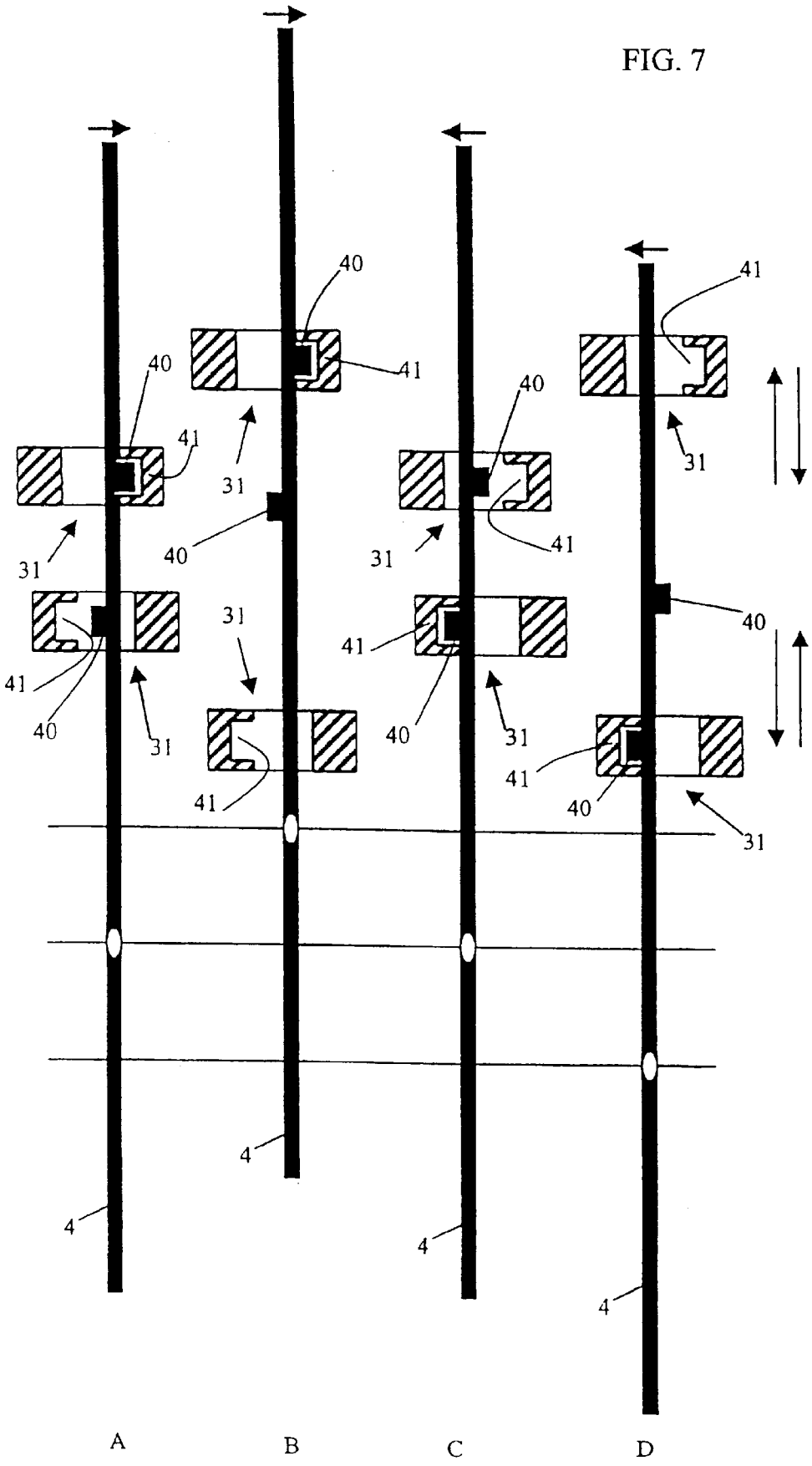
FIG. 7 is a diagrammatic view of an embodiment of an arresting device in various positions.
Figure 8:
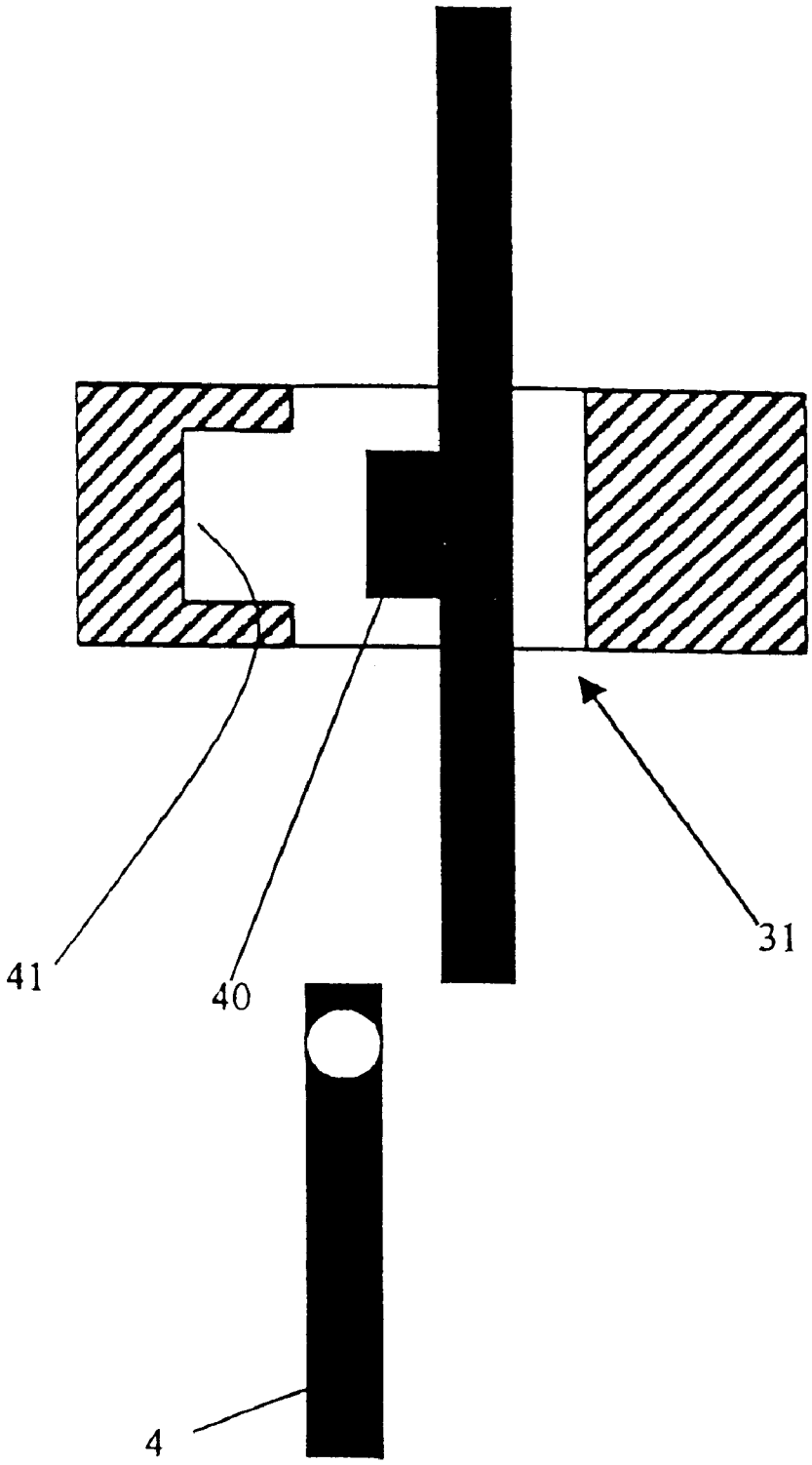
FIG. 8 is a detail view of one of the arresting devices shown in FIG. 7.

FIG. 7 shows an embodiment of arresting devices for connecting or releasing the positioning elements. Provided in the openings 31 of the guide lift elements are chambers 41, into which can engage noses provided on the healds 4. As will be apparent, the width of the opening of the openings 31 is of such a size that, when the noses 40 do not engage into the chambers or recesses 41, unimpeded lift movement is possible. As illustrated by the arrows indicated at the upper ends of the healds the healds are movable transversely to the lift direction, more specifically in such a way that the noses 40 can engage into the recess in the form of chambers 41 and thereby an arresting action is effected or in another position they can execute an unimpeded lift movement. The transverse movement is effected by means of suitable transverse motion devices (not shown) which are adapted to be actuable, Depending on the respective position involved the heald 4 is then entrained upwardly into the upper shed by the lower guide lift element or entrained downwardly into the lower shed with the other guide lift element.

The positions of the healds identified in FIG. 7 by A through D are as follows:

Position A:

Both guide lift elements with their openings 31 are in the middle shed. The nose 40 of the heald 4 is pressed towards the right by the transverse positioning device which for example is in the form of a microcircuit into the recess in the form of the chamber 41 of the opening 31 of the upper guide lift element.

Position B:

The guide lift elements are moved upwardly and downwardly respectively. As the nose 40 of the heald 4 engages into the chamber 41 of the opening 31 of the upper guide lift element the heald is entrained upwardly into the upper shed.

Position C:

Both guide lift elements with their openings 31 are in the middle shed. The nose 40 of the heald 4 is pressed by the transverse positioning devices towards the left into the chamber 41 of the opening 31 of the lower guide lift element.

Position D:

The guide lift elements are moved upwardly or downwardly respectively. As the nose 40 of the heald 4 engages into the chamber 41 of the opening 31 of the lower guide lift element the heald 4 is entrained downwardly into the lower shed.

Figure 9:
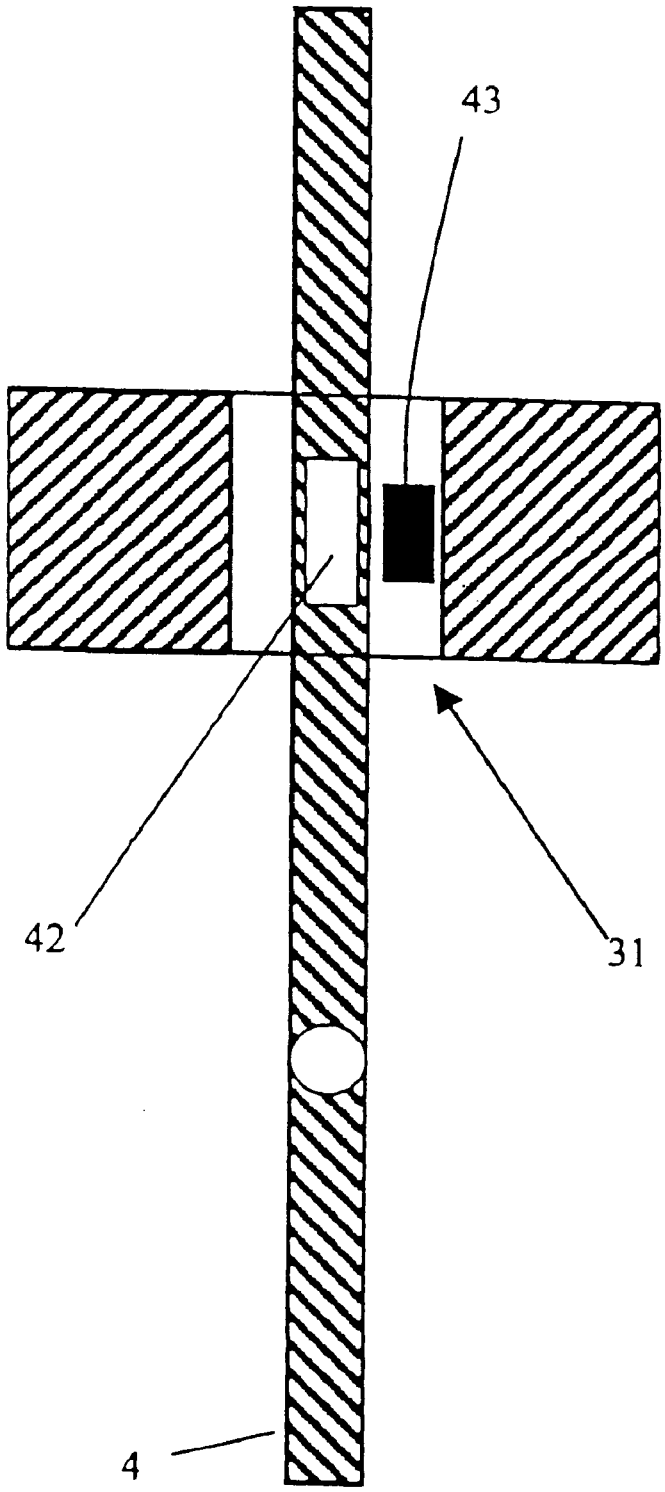
FIG. 9 is a diagrammatic view of an alternative embodiment of an arresting device.

In the embodiment diagrammatically shown in FIG. 9 the healds 4 do not have any noses but recesses 42. Associated with the recesses 42 are noses which are in the form of bars 43, pins or the like and which are arranged stationarily in the respective opening 31. In this case also, the transverse positioning device can provide that the healds are urged with their recesses on to the bars 43 or are not in engagement and can perform the lift movement. In the engagement position the heald is coupled to the guide lift element in question. The transverse positioning device can also operate magnetically. In the coupling position the heald is moved with the respective guide lift element into the upper shed or lower shed respectively.

The invention accordingly provides a harness-less shed forming device for individual thread control, wherein the required lift movements for producing the shed are implemented with elements which take over the lift movement and guidance of the healds at the same time. The elimination of an additional harness avoids the following known disadvantages:

premature wear of the harness due to twine breakages, comber and harness guide plate incisions, breakages of the counter-pull springs;

reduced numbers of revolutions of the weaving machine.

The required superstructure for the conventional Jacquard machine and the great structural height for the production areas are eliminated. That affords enormous economic benefits and technical advantages.

What is claimed is:

1. A shed forming device for the textile industry, comprising:

at least one positioning element movable in a vertical direction for moving a thread of a material web to be produced into a position which is in accordance with a pattern and a weave;

a thread eye affixed to the at least one positioning element for receiving the thread of the material web to be produced;

a lift guide element for moving the at least one positioning element in the vertical direction, the lift guide element having a selectively actuable arresting device affixed thereto for selectively connecting the at least one positioning element to the lift guide element and for selectively releasing the at least one positioning element from the lift guide element, the actuable arresting device having an opening for accepting and guiding the at least one positioning element;

a lift generating device associated with the lift guide element for moving the lift guide element in the vertical direction; and a stationary guide element having a selectively actuable arresting device affixed thereto for selectively connecting the at least one positioning element to the stationary guide element and for selectively releasing the at least one positioning element from the stationary guide element, the actuable arresting device having an opening for accepting and guiding the at least one positioning element.

2. The shed forming device of claim 1, wherein the at least one positioning element and thread eye are made of a substantially rigid material.

3. The shed forming device of claim 1, wherein the at least one positioning element and thread eye are made of a substantially flexible elastic material.

4. The shed forming device of claim 1, wherein the at least one positioning element and thread eye comprise a one-piece body.

5. The shed forming device of claim 1, wherein the lift guide element arresting device and the stationary guide element arresting device are electronically actuable.

6. The shed forming device of claim 1, wherein the lift guide element arresting device and the stationary guide element arresting device are pneumatically actuable.

7. The shed forming device of claim 1, wherein the lift guide element arresting device and the stationary guide element arresting device are mechanically actuable.

8. The shed forming device of claim 1, wherein the lift guide element arresting device and the stationary guide element arresting device each have a recess for selectively engaging corresponding noses provided on the at least one positioning element;

wherein the at least one positioning element is movable in a direction which is transverse with respect to the vertical direction;

wherein the shed forming device further comprises a selectively actuable device for moving the at least one positioning element transversely with respect to the vertical direction and into an engagement position; and wherein the widths of the opening of the lift guide element arresting device and the stationary guide element arresting device are of such a dimension that unimpeded vertical movement of the at least one positioning element is possible when the at least one positioning element is in a non-engagement position.

9. The shed forming device of claim 1, wherein the lift guide element arresting device and the stationary guide element arresting device each have a nose for selectively engaging corresponding nose openings provided on the at least one positioning element;

wherein the at least one positioning element is movable in a direction which is transverse with respect to the vertical direction;

wherein the shed forming device further comprises a selectively actuable device for moving the at least one positioning element transversely with respect to the vertical direction and into an engagement position; and wherein the widths of the opening of the lift guide element arresting device and the stationary guide element arresting device are of such a dimension that unimpeded vertical movement of the at least one positioning element is possible when the at least one positioning element is in a non-engagement position.

10. A shed forming device for the textile industry, comprising:

a plurality of positioning elements movable in a vertical direction for moving threads of a material web to be produced into positions which are in accordance with a pattern and a weave;

a thread eye affixed to each positioning element for receiving one of the threads of the material web to be produced;

two lift guide elements for moving the positioning elements in the vertical direction, each lift guide element having a plurality of selectively actuable arresting devices affixed thereto for selectively connecting the positioning elements to the lift guide element and for selectively releasing the positioning elements from the lift guide element, each actuable arresting device having an opening for accepting and guiding one of the plurality of positioning elements;

a lift generating device associated with the lift guide elements for moving the lift guide elements in the vertical direction; and a stationary guide element having a plurality of selectively actuable arresting devices affixed thereto for selectively connecting the positioning elements to the stationary guide element and for selectively releasing the positioning elements from the stationary guide element, each actuable arresting device having an opening for accepting and guiding one of the plurality of positioning elements.

11. The shed forming device of claim 10, wherein the lift guide element arresting device and the stationary guide element arresting device each have a recess for selectively engaging corresponding noses provided on the at least one positioning element;

wherein the at least one positioning element is movable in a direction which is transverse with respect to the vertical direction;

wherein the shed forming device further comprises a selectively actuable device for moving the at least one positioning element transversely with respect to the vertical direction and into an engagement position; and wherein the widths of the opening of the lift guide element arresting device and the stationary guide element arresting device are of such a dimension that unimpeded vertical movement of the at least one positioning element is possible when the at least one positioning element is in a non-engagement position.

12. The shed forming device of claim 10, wherein the lift guide element arresting device and the stationary guide element arresting device each have a nose for selectively engaging corresponding noses provided on the at least one positioning element;

wherein the at least one positioning element is movable in a direction which is transverse with respect to the vertical direction;

wherein the shed forming device further comprises a selectively actuable device for moving the at least one positioning element transversely with respect to the vertical direction and into an engagement position; and wherein the widths of the opening of the lift guide element arresting device and the stationary guide element arresting device are of such a dimension that unimpeded vertical movement of the at least one positioning element is possible when the at least one positioning element is in a non-engagement position.

13. A shed forming device for the textile industry, comprising:

a plurality of positioning elements movable in a vertical direction and in the direction transverse thereto for moving threads of a material web to be produced into positions which are in accordance with a pattern and a weave;

a thread eye affixed to each positioning element for receiving one of the threads of the material web to be produced;

two lift guide elements for moving the positioning elements in the vertical direction, each lift guide element having a plurality of selectively actuable arresting devices affixed thereto for selectively connecting the positioning elements to the lift guide element and for selectively releasing the positioning elements from the lift guide element;

a selectively actuable device for moving each of the positioning elements individually and transversely with respect to the vertical direction and into an engagement position;

a lift generating device associated with the lift guide elements for moving the lift guide elements in the vertical direction; and a stationary guide element having a plurality of selectively actuable arresting devices affixed thereto for selectively connecting the positioning elements to the stationary guide element and for selectively releasing the positioning elements from the stationary guide element;

wherein each of the lift guide element arresting devices and stationary guide element arresting devices has an opening for accepting and guiding one of the plurality of positioning elements, and each actuable arresting device further having a nose for selectively engaging corresponding nose openings provided on each corresponding positioning element, wherein the widths of the opening of the lift guide element arresting device and the stationary guide element arresting device are of such a dimension that unimpeded vertical movement of the at least one positioning element is possible when the at least one positioning element is in a non-engagement position.

* * * * *

UNITED STATES PATENT AND TRADEMARK OFFICE

CERTIFICATE OF CORRECTION

PATENT NO. : 6,494,237 B1
DATED : December 17, 2002
INVENTOR(S) : Uwe Piegeler

It is certified that error appears in the above-identified patent and that said Letters Patent is hereby corrected as shown below:

Title page,
Item [22], PCT Filed, replace "May 20, 2000" with -- March 20, 2000 --
Item [57], ABSTRACT,
Line 5, replace "Said" with -- Such --.
Line 12, replace "horeholes" with -- boreholes --

Drawings,
FIG. 1, Sheet 1, replace "State of the art" with -- Prior Art --

Column 3,
Line 37, delete "." after "with"

Column 8,
Line 32, replace "4n" with -- 4*n* --

Signed and Sealed this

Twenty-fifth Day of March, 2003

JAMES E. ROGAN
*Director of the United States Patent and Trademark Office*